United States Patent [19]

Garner et al.

[11] 4,426,839

[45] Jan. 24, 1984

[54] STRANDING WIRES

[75] Inventors: John N. Garner, Ontario; Jean M. Roberge, Pointe Claire, both of Canada

[73] Assignee: Northern Telecom Limited, Montreal, Canada

[21] Appl. No.: 413,179

[22] Filed: Aug. 30, 1982

[51] Int. Cl.[3] ..... H01B 13/04

[52] U.S. Cl. ..... 57/293; 57/13; 57/314; 57/344

[58] Field of Search ..... 57/6, 17, 293, 294, 57/314, 341-344

[56] References Cited

U.S. PATENT DOCUMENTS

| | | | |
|---|---|---|---|
| 3,847,190 | 11/1974 | Forester | 57/293 X |
| 3,910,022 | 10/1975 | Reed | 57/293 |
| 4,325,214 | 4/1982 | Zuber | 57/344 X |
| 4,359,860 | 11/1982 | Schleese et al. | 57/293 |

*Primary Examiner*—John Petrakes
*Attorney, Agent, or Firm*—R. J. Austin

[57] ABSTRACT

Wire stranding apparatus having tubular means having passage means to provide wire feedpaths, the tubular means being rotationally flexible about an axis, being held against rotation about this axis at an upstream end and having twisting means to cause alternating torsional twisting at its downstream end. The feedpaths are held in fixed positions apart either along the whole length of the tubular means where the tubular means is a single tube with at least two side-by-side passages or comprises tubes with their outer surfaces in continuous contact. When the tubular means comprises two or more spaced tubes, these are held in fixed relative positions at spaced locations along the tubes. To accommodate axial contraction and extension during twisting, the tubular means has an axially acting resilient means which maintains axial tension on the tubular means.

12 Claims, 5 Drawing Figures

STRANDING WIRES

This invention relates to apparatus for stranding wires.

It is known that the stranding of wires together offers physical and electrical advantages when the wires are individually insulated conductors as used in communications or other electrical systems. For example, the stranding of pairs of wires as used in telephone systems improves electrical characteristics, such as reducing crosstalk.

Conventionally, to continuously strand wires together in the same direction requires a heavy rotatable construction as the wire spools for feeding wire into the apparatus must also revolve about the machine axis. The excessive weight of the construction limits the operational speed. In order to avoid the rotation of the spools, a periodically reversing stranding operation is performed upon the wires and as it is desirable to strand long lengths of wires in each direction, accumulators become necessary.

In order to overcome problems with known stranding apparatus, simpler apparatus has been devised to give a periodic reverse stranding operation. This simpler apparatus as described in U.S. Pat. No. 3,910,022, granted Oct. 7, 1975 in the name of Phillip John Reed and entitled "Apparatus For Stranding Wires," involves the use of a tubular member one end of which is held stationary and the other torsionally twisted first in one direction and then the other around its longitudinal axis. Dividers positioned along the member divide the tube passage into separate paths for wires passing down the member. A twisting means at the downstream end of the tubular member, twists the member by rotating the downstream end of the member for a predetermined number of revolutions, first in one direction and then the other, to torsionally twist the member in reversing manner. A twist is imposed upon each wire by the twisting means and this twist causes the wires to strand together along their lengths as the wires emerge from the twisting means.

In U.S. Pat. No. 4,325,214 granted Apr. 20, 1982 in the name of Bretislav Pavel Zuber and entitled "Apparatus For Stranding Wire," the tubular member is replaced by an elongate member which is held stationary at an upstream end and is rotatable at the downstream end for twisting it. The member has a plurality of wire guiding elements extending radially outwards from it, each element having wire guiding holes whereby the wires are threaded through the holes from guiding element to guiding element while being located outwards from the elongate member.

With both of the above structures which are extremely flexible, they have a degree of uncontrollable lateral movement during use as a result of the twisting forces involved, and this makes them unsuitable for use in a machine where insufficient lateral clearances can be provided to allow for such movement.

In a further construction disclosed in U.S. Pat. No. 3,847,190, there is disclosed an apparatus for stranding wires comprising two tubes which are mounted in end housing, the two tubes being twisted together around a common longitudinal axis to provide twist in wires passed along the tubes. While this construction presents less lateral movement than in the constructions of Zuber and Reed, it does, however, suffer from a disadvantage in that the two tubes tighten together during twisting and untighten during the untwisting operation so as to slacken and move further apart. This tightening and slackening action changes the degree of drag upon the wires. Apart from this, because of the method of twisting these two tubes, the tubes do not twist uniformly from end to end and this results, together with the change in drag, to twisting of the wires in a non-uniform and smooth fashion.

The present invention provides an apparatus for stranding wires in which tubular means is provided having passage means defining feedpaths for at least two wires and wherein the feedpaths are held in fixed relative positions in at least some locations. With such a structure, during twisting of the tubular means, relative lateral movement of the feedpaths is either impossible or is restricted. The only way in which the twist can be accommodated therefore, is by a change in length of the tubular means during twisting. This is ensured by the use of a resilient means for placing axial tension upon the tubular means.

Accordingly, the present invention provides an apparatus for stranding wires comprising a tubular means, defining passage means forming at least two feedpaths for wires with the feedpaths held in fixed positions apart in at least some locations along the tubular means, the tubular means being rotatably flexible about a common axis to torsionally twist the tubular means and thus the passage means around said axis from an untwisted position;

holding means to hold the tubular means against rotation about said axis at an upstream position of the tubular means, wire twisting means at a downstream position of the tubular means to torsionally twist the tubular means, the twisting means rotatable with a downstream part of the tubular means, said feedpaths extending through the twisting means;

rotating means for rotating the twisting means together with the downstream part of the tubular means for a predetermined number of revolutions about the axis alternately in one direction and then the other, direction changing means to change the direction of rotation of the twisting means after the twisting means has rotated the predetermined number of revolutions in each direction, and resilient means associated with one of the ends of the tubular means to enable movement of said one end in the axial direction during twisting and untwisting of the tubular means.

In the above apparatus according to the invention, the tubular means preferably comprises at least two tubes each defining a passage forming one of the feedpaths. The untwisted position of the tubular means is one in which the tubes extend axially and lie substantially parallel. In this two tube arrangement, means is provided to prevent movement towards each other or apart of the tubes in spaced locations between the tube ends.

In another structure according to the invention, the tubular means comprises a single tube formed with two passages which lie side-by-side.

With the above structure, because the feedpaths are held in fixed positions, in at least some locations, then there is a more controlled degree of drag movement along the feedpaths than would be the case if no restraint were used. Also, in the inventive structure, the degree of drag is less erratic. Because of the prevention of relative movement of the feedpaths, it is found that twist takes place uniformly from end to end of the tubular means thus reducing drag.

Embodiments of the invention will now be described, by way of example, with reference to the accompanying drawings in which.

Figure 1:
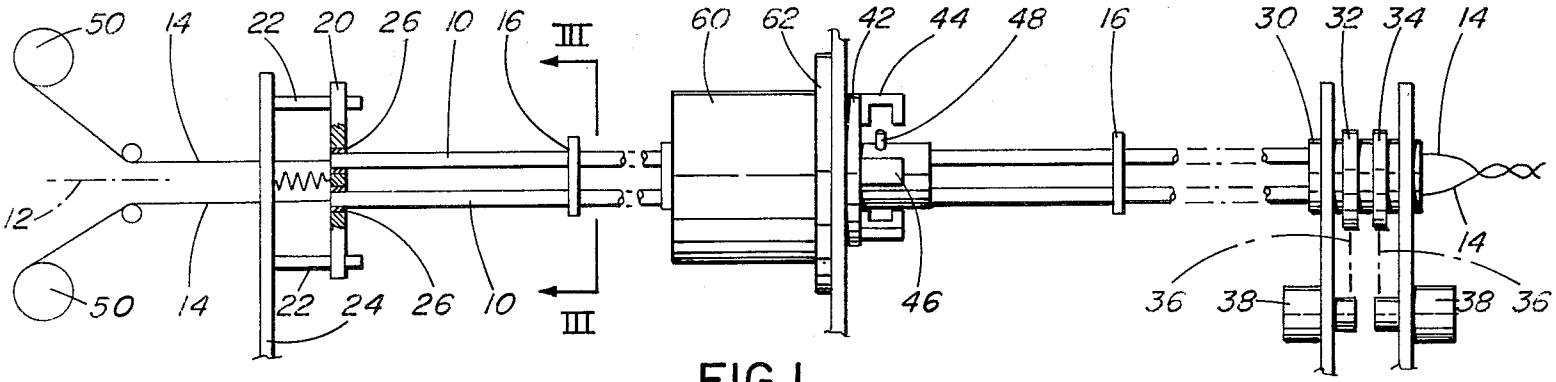
FIG. 1 is a diagrammatic side elevational view, partly in section, of apparatus according to the first embodiment with tubes of the apparatus shown untwisted.

The apparatus as shown in FIG. 1 comprises two side-by-side tubes 10 formed from stainless steel or from an acetal homopolymer as sold under the Trademark "DELRIN." The tubes may be of any length consistent with providing the twist required in wires to be passed along the tubes. The length of each tube is approximately 70 feet with an external diameter of 0.22 inches and an internal diameter of 0.075 inches. The two tubes are rotationally flexible about a common median axis 12 with which they lie parallel. The tubes also lie parallel to each other in a tube untwisted position (as shown by FIG. 1). The design of the tubes is such that each tube may be rotated around the axis 12 for a minimum of thirty-five turns each side from the equilibrium position as shown. Hence, upon alternating the direction of twist of the tubes, the tubes rotate for seventy turns in each opposite direction before a succeeding change in direction.

Each tube defines a feedpath for a wire 14 which is to be passed down the tube for the purpose of providing a twist in the wire whereby upon issuing from the downstream end of the tubes, the twist in the wires enables them to automatically strand together.

Figure 3:
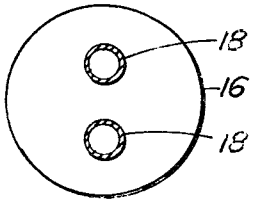
FIG. 3 is a cross-section through FIG. 1 taken along line 'III—III' in FIG. 1 and on a larger scale.

The tubes have a means for preventing movement towards each other or apart during their rotational movement around the axis 12. This movement prevention means comprises a series of discs 16 which are positioned at spaced intervals along the tubes as shown in FIG. 1. Each tube has two holes 18 as shown in FIG. 3 through which the tubes are passed in close fitting relationship and which hold the tubes in their spaced apart positions.

At an upstream end of the tubes there is provided a holding means to hold the tubes against rotation about the axis 12 at the upstream ends. This holding means comprises a tube support plate 20 having two holes adjacent its outer periphery upon which the plate is slidably received in the axial direction upon two parallel guides 22 which are mounted in an upstream position to a fixed frame member 24. By this means the plate 20 is movable in the axial direction of the tubes. Each tube is received at its upper end in bearings 26 in the support plate 20 whereby the upstream end of each tube is rotatable about its own axis while the tube is being rotated about the axis 12.

The upstream ends of the two tubes are movable together in the axial direction to enable a shortening and lengthening of the tubes which is necessary as the tubes twist together and untwist about the axis 12 while maintaining their distances apart. To accommodate the movement of the upstream tube ends, a resilient means is incorporated in the apparatus to ensure that the tube ends move in a controlled fashion. The resilient means places tension upon the tubes so as to assist in preventing any lateral movement of the tubes due to the forces created during twisting. This resilient means comprises two tension springs 28, both of which are secured at one end to the frame member 24 and at the other end to the plate 20. The two springs 28 are superimposed one upon another in FIG. 1, whereby only one is seen.

At the downstream end of the tubes, a twisting means is provided for twisting the two tubes together in alternating directions about the common axis 12. This twisting means comprises a cylinder 30 formed with two holes within which the downstream ends of the two tubes are secured. Two annular electric clutches 32 and 34 have their driven sides secured to the cylinder for driving it, alternately in opposite directions. Each clutch is drivable by a drive belt 36 continuously driven in opposite directions by electric motors 38 which form a rotating means for rotating the cylinder 30.

Figure 4:
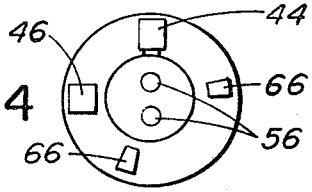
FIG. 4 is a cross-sectional view taken along line 'IV—IV' in FIG. 2.
Figure 2:
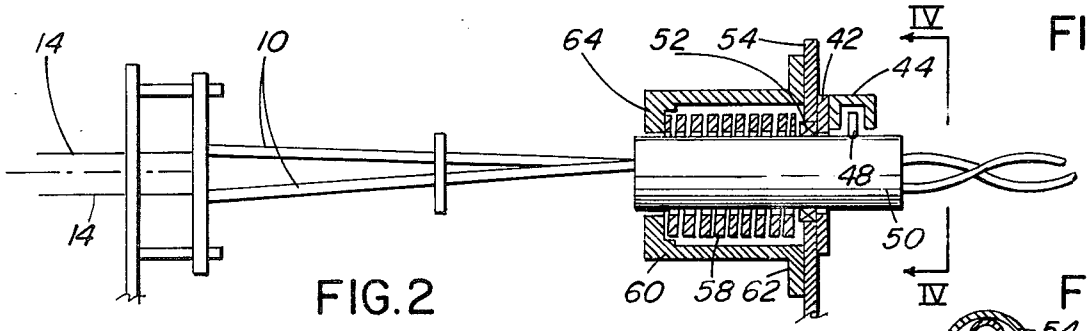
FIG. 2 is a view similar to FIG. 1 with the tubes twisted and with another part of the apparatus in section.

A direction changing means 40 is provided and this is located at a short distance downstream from the upstream ends of the tubes as shown by FIG. 1, i.e. at a position in which the tubes rotate less than 360° around the axis 12 for the maximum amount of turns, i.e. seventy at the downstream ends of the tubes. This direction changing means is, in fact, located at a position in which each tube turns only 45° in each direction for the thirty-five rotations at their downstream ends at each side of the untwisted position shown in FIG. 1. The changing means comprises an annular base plate 42 through which the tubes pass and two magnetic switch means comprising two U-shaped heads 44 and 46 located at 90° apart around the plate 42 (FIGS. 1 and 4). Each head carries a magnet in one leg of the U for creating an electric field and inducing an electric current into a coil in the other leg of the U. The changing means also comprises a trigger device for interrupting the magnetic field around each magnet for the purpose of changing the signal received by the coil in a particular head. The resultant change in signal causes a disconnection of one of the clutches to the cylinder 30 and a connection of the other clutch to the cylinder. The trigger device comprises an interrupter arm 48 which is secured and extends outwardly from a cylinder 50 (FIG. 2) which is mounted in bearings 52 in a frame 54. The cylinder 50 is formed with two axial holes 56 (FIG. 4) through which the tubes 10 pass. The arm moves around the axis 12, from the position in which it lies within a gap in the U of one of the heads as shown in FIG. 2, to a position in which it lies in the gap of the other head. With the tubes untwisted as in FIG. 1, the arm 48 lies midway between the heads. Upon the arm reaching the position of FIG. 2, it interrupts the magnetic field created by the magnet in head 44 and this changes the signal to the respective coil whereby the drive through the clutches is changed and the rotational direction of the tubes is immediately alternated. This change occurs for a 90° operation of the interrupter arm which corresponds to 70 revolutions at the downstream end of the tubes between one alternating position and the other.

A damping device is provided, to prevent the tubes, at the position of interrupter arm 48, from twisting uncontrollably because of any stored twist throughout the lengths of the tubes and which may not be dispersed in desired manner upon change in the rotational direction. This damping device which comprises the cylinder 50, also includes a torsion spring 58 which closely surrounds the cylinder, on the upstream side of frame 54, and a cylindrical surround 60. Surround 60 is secured at flange 62 to frame 54. The spring is securely attached (as by brazing or otherwise bonding) to the cylinder 50 at the downstream end of the spring. The upstream end of the spring is securely attached to an upper end flange 64 of the surround 60. The twisting of the tubes 10 needs to overcome torsional resistance of the spring to enable the arm 48 to move from one head 44, 46 to the other and this creates a damping effect to ensure the arm position always corresponds to the number of twists in the downstream ends of tubes 10. Two safety heads 66 are provided upon the base plate 42. These heads 66 are of the same construction as head 44 or 46 and are disposed spaced around the plate 42, each from head 44 and 46, i.e. in the 270° arc not normally travelled by the interrupter arm. In the unlikely event that the arm 48 travels through a head 44 or 46 without the rotational direction of the tubes being alternated, then the arm will enter the gap in one of the heads 66 after travelling a short distance further. Interruption of the magnetic field in either head 66 results in stopping of the electrical motors 38 whereby further twisting of the tubes, which could have resulted in damage to them, is prevented. Alternatively, a single head 66 (not shown) is provided, equally spaced from the heads 44 and 46.

The direction changing means is described more completely in patent application Ser. No. 413,178, filed concurrently with this present application in the names of John Nicholas Garner, Jean Marc Roberge and Norbert Meilenner and entitled "Apparatus For Stranding Wire."

In use of the apparatus described in the first embodiment, wire is passed through each of the tubes 10 from spools 50 mounted in fixed positions relative to the frame member 24. To cause the wires to become stranded together, the tubes containing the wires are rotated together at their downstream ends by the twisting means, around the common axis 12 and also relative to their upstream ends which are prevented from rotating around this axis. Hence upon the cylinder 30 being rotated for thirty-five revolutions in the first direction, then the tubes are twisted along their length for these thirty-five revolutions. The direction changing means 40 then operates as described in the application in the names of Garner, Roberge and Meilenner as referred to above, to change the direction of rotation of the cylinder 30. When the cylinder has completed seventy revolutions in the opposite direction, i.e. thirty-five revolutions on the other side of the untwisted position shown in FIG. 1, then the changing means operates once more to alternate the direction of rotation again. Thus the two tubes are twisted together first in one direction and then the other to prevent the wires from stranding together upstream of the twisting means.

Upon the wires issuing from the cylinder 30 they may be allowed to strand together immediately as shown by FIG. 1 to form a twisted pair of wires. Alternatively, the construction described in the first embodiment may form a part of a larger stranding apparatus for stranding together multiple pairs of wires. In this case a separation tube means, not shown, may be incorporated downstream of the cylinder 30 to prevent the wires from stranding together downstream of the twisting means and until they reach a stranding station at a further downstream position. Such an apparatus for stranding together multiple wire pairs is described in copending patent application Ser. No. 413,175, in the names of John Nicholas Garner, Jean Marc Roberge and Oleg Axiuk, filed concurrently with this present application and entitled "Forming Cable Core Units." The apparatus described in this present embodiment is particularly suitable for apparatus for stranding together multiple wire pairs in that a negligible amount of lateral movement takes place in the tubes during their twisting and untwisting operations whereby a plurality of such pairs of tubes may be located side-by-side in closely spaced positions without danger of the tubes contacting and damaging one another in use of the multiple apparatus.

Also during use with the two tubes twisting and untwisting together, the discs 16 hold them in their spaced positions apart at intervales along the tubes and because of this, the only manner in which the twist and untwist can be accommodated in the tubes is by lengthening and shortening their apparent lengths axially. This is accomplished by the movable support plate under the urgency of the springs 28 so that the support plate is continuously moving in alternate directions along the guides 22 during the twisting and untwisting movement. The control of the discs and the springs 28 provide a uniformity of twist along the tubes. As the distance apart of the tubes is maintained at spaced intervals and the tube twist is controlled, then there is a control on the degree of drag upon the wires as they pass through the tubes.

The movable support plate and springs 28 are also of importance for maintaining axial tension when temperature effects are applied to the tubes, either atmospheric or work induced. Temperature caused length changes on tubes 70 feet or more in length may be substantial and without the spring controlled axial tension, tube lateral movement and drag on the wires would be unpredictable.

In addition, the use of tubes enables the wires to be threaded with ease through them before twisting commences. When twisting commences, as the tubes apply pressure against the side of each wire continuously along the tube length then the pressure per unit length of tube is low compared to that which results when spaced dividers and guiding elements are used as with the prior art. Hence, lower forces need to be overcome to enable movement of the wires through the tubes. Indeed, wire throughput speeds of 450 feet/minute can be obtained through each tube of this apparatus without operating at full capacity of the apparatus. With thirty-five turns of the tubes in each direction from the equilibrium untwisted position, this has provided a 2.9 inch pitch for the stranded together wires.

A further advantage which stems from the construction described in the first embodiment is with regard to the use of the bearings 26. These bearings enable each tube to rotate about its own axis at the upstream end and this reduces the torsional twist upon each individual tube because the upstream end of each tube is allowed to freely rotate under the twisting effect imposed upon the tube. Hence, the use of freely rotatable upstream ends of the tubes in the way described ensures that the useful life of the tubes is increased by a reduction in the torsional stresses.

In a modification of the first embodiment (not shown), the spring 58 has an adjustable clamp means attachable to any point on the spring. This has the effect of changing the stiffness in the spring and the number of twists in the tubes before the arm 48 moves from one head 44 or 46 to the other to effect direction change in cylinder 30.

Figure 5:
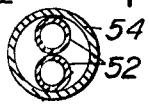
FIG. 5 is a cross-section similar to FIG. 3 and of a second embodiment.

In a second embodiment (FIG. 5), the two-tubular construction held by the discs 16 is replaced by two side-by-side tubes 52 which are held together by a surrounding holding tube 54 which engages the outer peripheral surfaces of the tubes 52 as shown. The tube 54 is bonded to the tubes 52 at the positions of contact. At its downstream end the tube 54 is provided with a twisting means as described in the first embodiment. At the upstream end, the tube 54 is mounted to a tube support plate also as described above except that the tube is non-rotatably fixed to the support plate whereby the upstream ends of the tubes 52 are also fixed.

In use, with the outer tube 54 being rotated by the twisting means, the two tubes 52 are also twisted one about the other about a central axis indicated by arrow 56 in FIG. 4 to apply twist to the wires being fed individually down the two tubes 52. The construction of the second embodiment has similar advantages to those described in the first embodiment.

What is claimed is:

1. Apparatus for stranding wire comprising:

a tubular means defining passage means forming at least two feedpaths for wires along the tubular means with the feedpaths held in fixed positions apart in at least some locations along the tubular means, the tubular means being rotatably flexible about a common axis to torsionally twist the tubular means and thus the passage means around said axis from an untwisted position;

holding means to hold the tubular means against rotation about said axis at an upstream position of the tubular means;

wire twisting means at a downstream position of the tubular means to torsionally twist the tubular means, said feedpaths extending through the twisting means;

rotating means for rotating the twisting means together with the downstream part of the tubular means for a predetermined number of revolutions about the common axis alternately in one direction and then the other;

direction changing means to change direction of rotation of the twisting means after the twisting means has rotated the predetermined number of revolutions in each direction; and resilient means associated with one of the ends of the tubular means to enable movement of said one end in the axial direction during twisting and untwisting of the tubular means.

2. Apparatus for stranding wire comprising at least two tubes, each defining a passage forming a feedpath for a wire along the tube, the tubes being rotatably flexible about a common axis to torsionally twist the tubes and thus the passages around said axis from an untwisted position in which the tubes extend axially and lie substantially parallel, holding means to hold the tubes against rotation about said axis at an upstream position of the tubes, wire twisting means at a downstream position of the tubes to torsionally twist the tubes, said feedpaths extending through the twisting means, rotating means for rotating the twisting means together with the downstream part of the tubes for a predetermined number of revolutions about the common axis alternately in one direction and then the other, direction changing means to change direction of rotation of the twisting means after the twisting means has rotated the predetermined number of revolutions in each direction, means to prevent movement towards each other or apart of the tubes in spaced locations between the ends of the tubes, and resilient means associated with one of the ends of each tube to enable movement of said one end in the axial direction during twisting and untwisting of the tubes.

3. Apparatus according to claim 2, wherein the means to prevent movement towards each other or apart of the tubes comprises a plurality of tube holding means which are spaced apart in the axial direction and hold the tubes in fixed positions apart.

4. Apparatus according to claim 3, wherein the tube holding members comprise discs having a hole or holes through which the tubes extend.

5. Apparatus according to claim 2, wherein the means to prevent movement towards each other or apart of the passages comprises a holding tube which surrounds the two tubes and holds them in fixed relative positions.

6. Apparatus according to claim 2, wherein the holding means comprises an end plate mounted upon the upstream ends of the two tubes, the end plate being slidably carried by a fixed frame and the resilient means comprises at least one spring associated with the end plate to urge it towards the frame and place the tubes in axial tension.

7. Apparatus according to claim 6, wherein the end plate is slidable upon two guide shafts mounted upon the frame, and two tension springs located between the frame and the end plate and one at each side of the longitudinal axis urge the plate along the guide shafts towards the frame.

8. Apparatus according to claim 6, wherein the two tubes are individually rotatably mounted in the end plate.

9. Apparatus according to claim 2, wherein the two tubes are individually rotatably mounted each by one end.

10. Apparatus according to claim 1, wherein the tubular means comprises a single tube formed with two parallel passages forming the passage means.

11. Apparatus according to claim 1, wherein the tubular means comprises a single tube formed with a single passage forming the passage means, the single passage having two spaced regions to define the feedpaths and a narrower region interconnecting the spaced region.

12. A method of stranding wires together comprising feeding the wires along individual feedpaths formed by passage means within tubular means, torsionally twisting the tubular means about a longitudinal axis alternately for a predetermined number of twists in one direction and then in the other, from an untwisted position, to twist the individual wires as they are being fed through the passage means alternately in said directions, said alternate twisting being performed while preventing the feedpaths from moving laterally towards each other or apart and while a resilient load is applied upon one end of the tubular means to place it in axial tension, issuing the wires from the tubular means in an individually twisted condition and enabling the twisted wires to strand together by virtue of their twist in a position downstream from the tubular means.

* * * * *